US010995549B2

(12) United States Patent
Kay et al.

(10) Patent No.: US 10,995,549 B2
(45) Date of Patent: May 4, 2021

(54) DEVICE FOR STABILISING A LADDER, AND A LADDER

(71) Applicant: THE LACKET COMPANY PTY LTD, Kiama Downs (AU)

(72) Inventors: David Kay, Kiama Downs (AU); Daniel Seidel, Kiama Downs (AU)

(73) Assignee: THE LACKET COMPANY PTY LTD, Kiama Downs (AU)

( * ) Notice: Subject to any disclaimer, the term of this patent is extended or adjusted under 35 U.S.C. 154(b) by 5 days.

(21) Appl. No.: 16/073,260

(22) PCT Filed: Jan. 27, 2017

(86) PCT No.: PCT/AU2017/050068
§ 371 (c)(1),
(2) Date: Jul. 26, 2018

(87) PCT Pub. No.: WO2017/127895
PCT Pub. Date: Aug. 3, 2017

(65) Prior Publication Data

US 2019/0048663 A1 Feb. 14, 2019

(30) Foreign Application Priority Data

Jan. 27, 2016 (AU) ..... 2016900229

(51) Int. Cl.
*E06C 7/48* (2006.01)
*E06C 1/12* (2006.01)
(Continued)

(52) U.S. Cl.
CPC ..... *E06C 7/486* (2013.01); *E06C 1/12* (2013.01); *E06C 1/34* (2013.01); *E06C 7/188* (2013.01); *E06C 7/42* (2013.01); *E06C 7/48* (2013.01)

(58) Field of Classification Search
CPC ... E06C 1/10; E06C 1/12; E06C 1/125; E06C 1/34; E06C 7/188; E06C 7/16;
(Continued)

(56) References Cited

U.S. PATENT DOCUMENTS 1,030,905 A * 7/1912 Lucas ..... E06C 7/48 182/206
1,393,048 A * 10/1921 Stiles ..... E06C 1/345 182/206
(Continued)

OTHER PUBLICATIONS

DE 202007012803, Feb. 2009, Sperian Fall Prot Deutschlan, (Year: 2009).*
(Continued)

*Primary Examiner* — Daniel P Cahn
*Assistant Examiner* — Shiref M Mekhaeil
(74) *Attorney, Agent, or Firm* — Nath, Goldberg & Meyer; Richard C. Litman

(57) ABSTRACT

A device for stabilising a ladder against a surface, the ladder having a pair of stiles and a plurality of rungs connected therebetween, the device comprising:

an engagement mechanism for releasably engaging two adjacent rungs, the engagement mechanism including two opposed receiving portions for at least partially receiving a rung, at least one of the receiving portions being selectively movable relative to the other thereby allowing the engagement mechanism to urge against the adjacent rungs; and at least one arm pivotably connected to the engagement mechanism to allow pivoting thereof to a fixed angle relative to the engagement mechanism, the at least one arm having an abutting portion for abutting under the surface, thereby allowing the ladder to be wedged between the surface and ground level to stabilise the ladder.

5 Claims, 14 Drawing Sheets

(51) Int. Cl.
*E06C 1/34* (2006.01)
*E06C 7/18* (2006.01)
*E06C 7/42* (2006.01)

(58) Field of Classification Search
CPC . E06C 7/165; E06C 7/081; E06C 7/42; E06C 7/48; E06C 7/486
See application file for complete search history.

(56) References Cited

U.S. PATENT DOCUMENTS 1,470,489 A * 10/1923 Schuh ..... E06C 1/345 248/694
1,695,428 A * 12/1928 Johnson ..... E06C 1/36 182/206
2,439,430 A * 4/1948 Hurd ..... E06C 1/36 182/206
3,067,836 A * 12/1962 Carnicelli ..... E06C 7/16 182/121
3,486,580 A * 12/1969 Norton ..... E06C 7/48 182/214
3,603,431 A * 9/1971 Nameche ..... E06C 1/34 182/206
3,910,380 A * 10/1975 Nameche ..... E06C 1/34 182/206
3,941,341 A * 3/1976 Brogdon, Jr. ..... E06C 7/12 248/55
4,017,047 A * 4/1977 Brogdon, Jr. ..... E06C 5/14 248/55
4,100,998 A * 7/1978 Marquez ..... E06C 7/16 182/116
4,218,156 A * 8/1980 Logan ..... F16B 7/06 403/320
4,359,138 A * 11/1982 Kummerlin ..... E06C 7/16 182/107
4,369,860 A * 1/1983 Beane ..... E06C 7/486 182/107
4,678,061 A * 7/1987 Jordan ..... E06C 1/345 182/107
4,938,312 A * 7/1990 Trail ..... E06C 1/345 182/206
5,072,808 A * 12/1991 Spalt ..... E06C 7/081 182/103
5,358,071 A * 10/1994 Stennett ..... E04D 13/12 182/107
5,388,665 A * 2/1995 Newman ..... E06C 7/16 182/118
5,460,241 A * 10/1995 LaBelle ..... E06C 7/16 182/121
6,019,191 A * 2/2000 Flores ..... E06C 7/48 182/107
6,848,540 B2 * 2/2005 Kvam ..... E06C 7/14 182/121
6,913,114 B1 * 7/2005 Blehm ..... E04D 15/00 182/104
7,077,238 B2 * 7/2006 Butler ..... E06C 7/14 182/121
7,163,084 B1 * 1/2007 Blehm ..... E06C 7/423 182/172
7,377,360 B1 * 5/2008 Misiak ..... E06C 7/48 182/107
7,556,125 B1 * 7/2009 Blehm ..... E06C 7/488 182/107
9,366,083 B2 * 6/2016 Graham, Sr. ..... E06C 7/188
9,593,532 B2 * 3/2017 Dehoff ..... E06C 7/48
10,464,204 B2 * 11/2019 Angold ..... B25H 1/0042
10,494,865 B2 * 12/2019 Valdez Ontiveros ..... E06C 1/36
2005/0139425 A1 * 6/2005 Thomas ..... E06C 1/34 182/214
2006/0060423 A1 * 3/2006 Astor ..... E06C 7/085 182/220
2010/0012433 A1 * 1/2010 Ross ..... E06C 1/125 182/211
2010/0213009 A1 * 8/2010 Guinovart ..... E06C 1/08 182/206
2011/0127110 A1 6/2011 Trang
2011/0315476 A1 * 12/2011 Clarkson ..... E06C 7/48 182/107
2012/0175188 A1 * 7/2012 Xu ..... E06C 7/44 182/107
2014/0326538 A1 * 11/2014 Najey ..... E06C 7/08 182/129
2014/0367197 A1 * 12/2014 Mathieson ..... E06C 7/486 182/214
2019/0136622 A1 * 5/2019 Levy ..... E06C 7/48
2019/0292850 A1 * 9/2019 Weyrauch ..... E06C 7/16

OTHER PUBLICATIONS

Extended European Search Report, Application No. 17743497.4, dated Sep. 6, 2019.

* cited by examiner

FIGURE 8 (iii)

FIGURE 8 (ii)

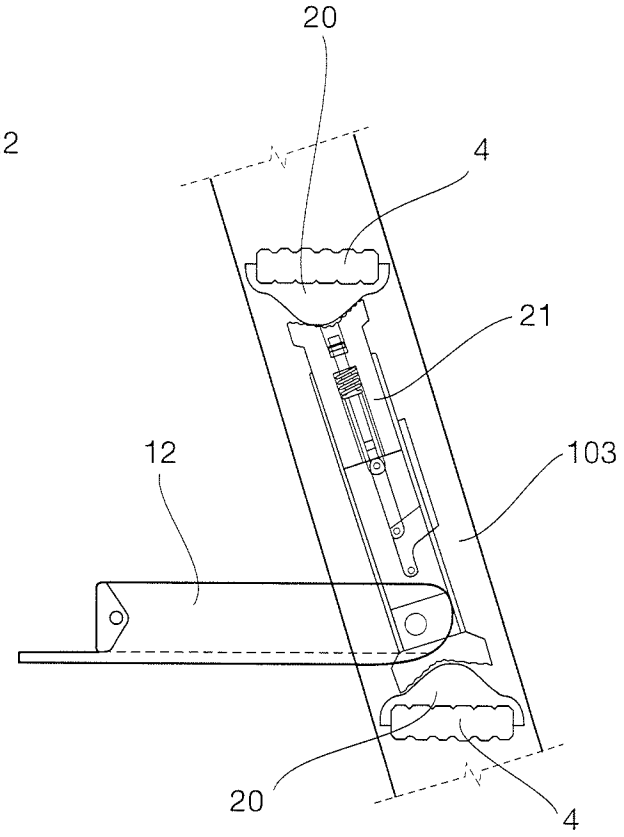
FIGURE 12(iii)

DEVICE FOR STABILISING A LADDER, AND A LADDER

This is a National Phase Application filed under 35 U.S.C. § 371 as a national stage of International Application No. PCT/AU2017/050068, filed Jan. 27, 2017, claiming priority from Australian Patent Application No. 2016900229, filed Jan. 27, 2016, the entire content of each of which is hereby incorporated by reference in its entirety.

TECHNICAL FIELD

The present invention relates to a device for stabilising a ladder against a structure, and a stabilised ladder and extendable ladder.

BACKGROUND TO THE INVENTION

Ladders typically comprise a pair of stiles, or rails, which extend longitudinally and between which a plurality of rungs are affixed. Extendable ladders typically comprise two such ladders, whereby a first ladder has a sleeve or guide for receiving the stiles of a second ladder to allow the second ladder to telescopically slide relative to the first ladder.

Ladders are used to allow a user to access an elevated location. The stiles are arranged on a ground surface and against a structure, and the user climbs the rungs to access the elevated location. When a user climbs towards a top end of the ladder, the elevated mass of the user can cause the ladder to become unstable, which can result in the user falling and consequently injury or death.

It is therefore common for users to attempt to stabilise the ladder to decrease the likelihood of such falls. This often involves tying the ladder to a structure, such as connecting ropes or straps between the ladder and anchor points affixed to a building, or manually stabilising the ladder by another user located on the ground.

Various ladder stabiliser devices are also well known. These typically comprise a pair of arms which are secured towards a top end of the ladder and extend laterally therefrom. The arms are arranged to rest against the structure, for example, against a wall or roof, to increase the width of support for the top end of the ladder.

Similarly, gutter clamps are known and generally affixed towards a top end of the ladder. The gutter clamps engage a gutter arranged around a periphery of a roof to secure the ladder to the gutter.

Whilst the prior art approaches mentioned above may assist stabilising a ladder, these also suffer from a number of drawbacks. For example, securely tying a ladder to a building can require a substantial amount of time and skill to set up or disassemble. Also, conventional ladder stabilisers only provide limited lateral stability and do not prevent a ladder from falling backwards, away from the structure. Furthermore, such devices can occupy space between rungs and present a trip hazard, and typically prevent an extendable ladder from being retracted to a storage configuration, as the device interferes with the telescoping mechanism. Gutter clamps are also problematic, as these require a gutter to be present to function, and often damage the gutter when used.

Accordingly, it would be useful to provide a device for stabilising a ladder, or a ladder with improved stability, which is less prone to falling away from a structure. Furthermore, it would be useful to provide such a device and/or ladder which minimises potential trip hazards during use and/or allows an extendable ladder to be extended and retracted.

SUMMARY OF THE INVENTION

Broadly the present invention discloses an apparatus for connection to a ladder whereby a ladder is wedged between the ground and against a surface and/or under the surface.

In broad forms the invention is a unitary device which engages with rungs or stiles with an arm extending therefrom so as to provide the wedge against the surface.

In broad forms the device can adopt a stowed position so that the ladder can be connected to the ladder in a readily transportable position for quick deployment, and a deployed position so as to form a stabiliser which is ready for wedging.

According to one aspect of the invention there is provided a device for stabilising a ladder against a surface, the ladder having a pair of stiles and a plurality of rungs connected therebetween, the device comprising an engagement mechanism for releasably engaging two adjacent rungs, the engagement mechanism including two opposed receiving portions for at least partially receiving a rung, at least one of the receiving portions being selectively movable relative to the other thereby allowing the engagement mechanism to urge against the adjacent rungs and at least one arm pivotably connected to the engagement mechanism to allow pivoting thereof to a fixed angle relative to the engagement mechanism, the at least one arm having an abutting portion for abutting under the surface, thereby allowing the ladder to be wedged between the surface and ground level to stabilise the ladder.

According to another aspect of the invention there is provided a ladder comprising a pair of stiles, a plurality of rungs connected between the stiles and a pair of arms pivotable relative to the stiles, to allow pivoting thereof between a stowed position substantially parallel to the stiles and a deployed position at a fixed angle relative to the stiles, each arm arranged proximal to a respective stile and having an abutting portion for abutting under the surface, thereby allowing the ladder to be wedged between the surface and ground level to stabilise the ladder.

In another aspect, there is provided a device for stabilising a ladder against a surface, the ladder having a pair of stiles and a plurality of rungs connected therebetween, the device comprising: at least one arm connected to the ladder, extending therefrom at a selected angle relative to the ladder, the at least one arm having an abutting portion for abutting under the surface, thereby allowing the ladder to be wedged between the surface and ground level to stabilise the ladder, the device further including a jack foot engaged with the ground and a base portion of the ladder so as in use to elevate the ladder so that the ladder is wedged between the surface and the ground.

In yet another aspect there is provided a device for stabilising a ladder against a surface, the ladder having a pair of stiles and a plurality of rungs connected therebetween, the device comprising: an engagement mechanism for releasably engaging the ladder by the stiles and/or the rungs, and at least one arm pivotably connected to the engagement mechanism to allow pivoting thereof to a fixed angle relative to the engagement mechanism, the at least one arm having an abutting portion for abutting under the surface, thereby allowing the ladder to be wedged between the surface and ground level to stabilise the ladder.

In broad forms there is provided a ladder with a stabiliser which can adopt a stowed position out of the way of extending portions, and a deployed position ready for quick stabilising wedging under or against a surface.

Other aspects are disclosed.

BRIEF DESCRIPTION OF THE DRAWINGS

Preferred embodiments of the invention will now be described, by way of example only and only so as to enable a clearer understanding of the invention, with reference to the accompanying drawings in which.

DETAILED DESCRIPTION OF PREFERRED EMBODIMENTS

Figure 1:
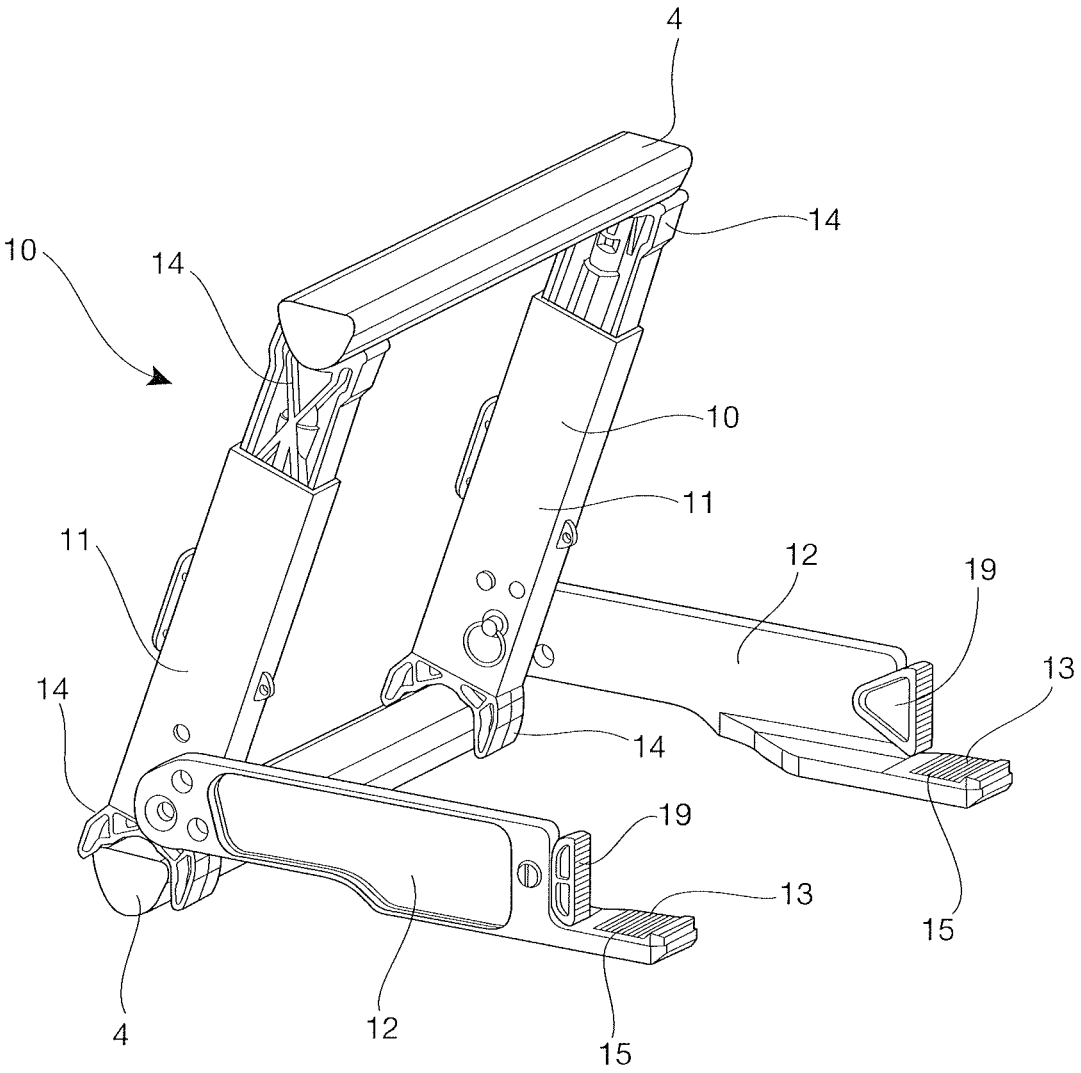
FIG. 1 is an isometric view of one embodiment of a stabiliser device shown in a deployed position.
Figure 2:
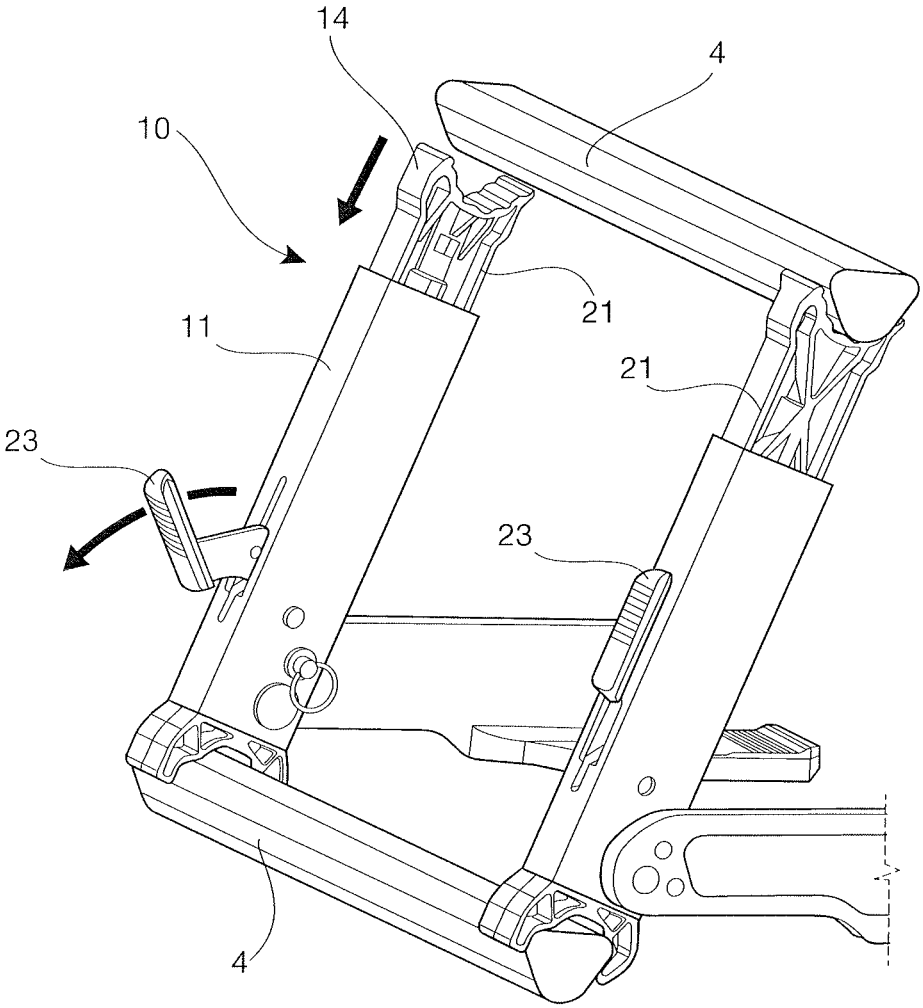
FIG. 2 is an isometric view of the stabiliser device being deployed.
Figure 3:
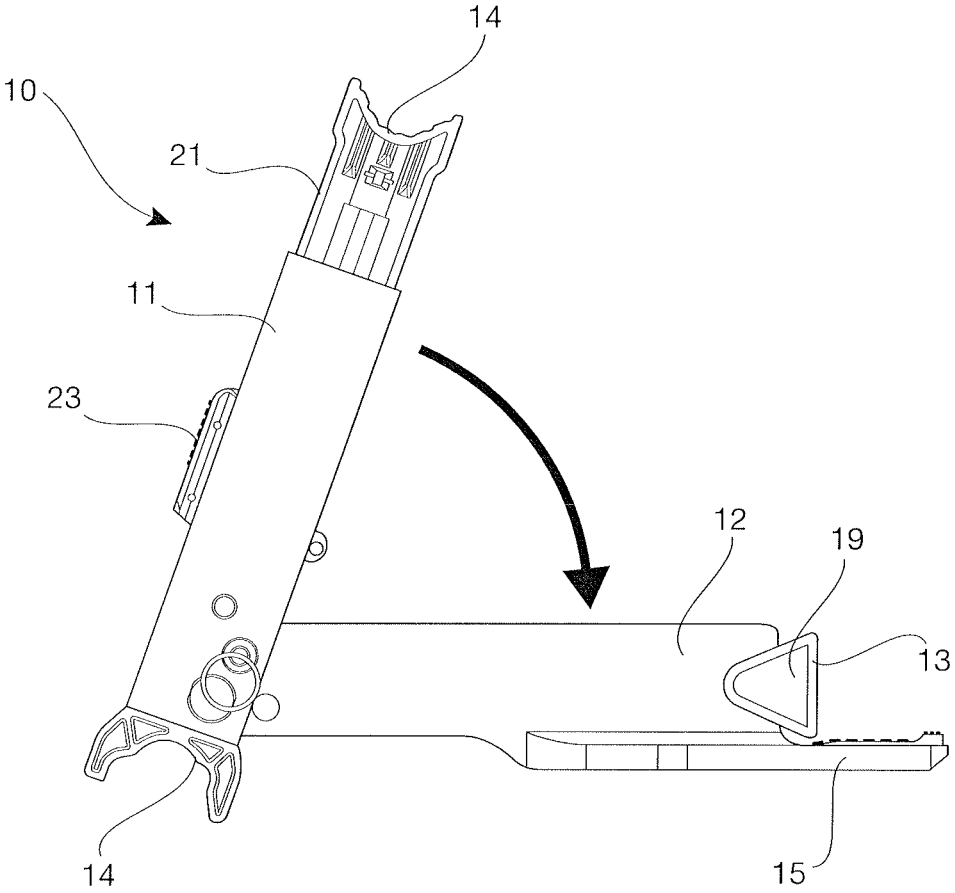
FIG. 3 is a side elevation view of the stabiliser device in the deployed position.

Referring to the drawings, in particular FIGS. 1 to 4, there is shown two stabiliser devices 10 secured to a ladder 1 (certain features of the ladder in FIGS. 1 to 4 except for the rungs 4 have been removed for clarity). The devices are for stabilising the ladder 1 against a surface, in some instances having an underside. The ladder 1 has a pair of stiles 2 and a plurality of rungs 4 connected therebetween.

The device 10 comprises an engagement mechanism 11 for releasably engaging two adjacent rungs 4, the engagement mechanism 11 including two opposed receiving portions 14, each one being for at least partially receiving one of the rungs 4. At least one of the receiving portions 11 is selectively movable (in this embodiment extensible) relative to the other thereby allowing the engagement mechanism to urge against the adjacent rungs 4 so that the device is retained in a retained position between the rungs. It is to be understood that the movement between the receiving portions may be some other movement other than extending, such as for example, pivoting, or detachment. The extensible movement may be by hydraulic ram, or threading, or other suitable mechanisms.

It is to be understood that the engagement mechanism could attach to another part of the ladder 1, say, to the stiles by, for example, a hinged sleeve arrangement having half-sleeves clasped or otherwise fastened together, or a part sleeve without a hinge, so as to at least partially surround a stile. There may be some other coupling arrangement which would be suitable, which could couple an arm to the rung and/or stile.

There is provided at least one arm 12 pivotally connected to the engagement mechanism 11 to allow pivoting thereof to a predetermined, or selected, or fixed angle relative to the engagement mechanism. The at least one arm 12 has an abutting portion for abutting under the surface, thereby allowing the ladder to be wedged between the surface and ground level to stabilise the ladder. The arm 12 could be detachably connected to the engagement mechanism 11, or it could be have an extendable form, similar in arrangement to that described herein for the relatively movable receiving portions 14—threadably extensible or similar—as described for that mechanism.

Figure 5:
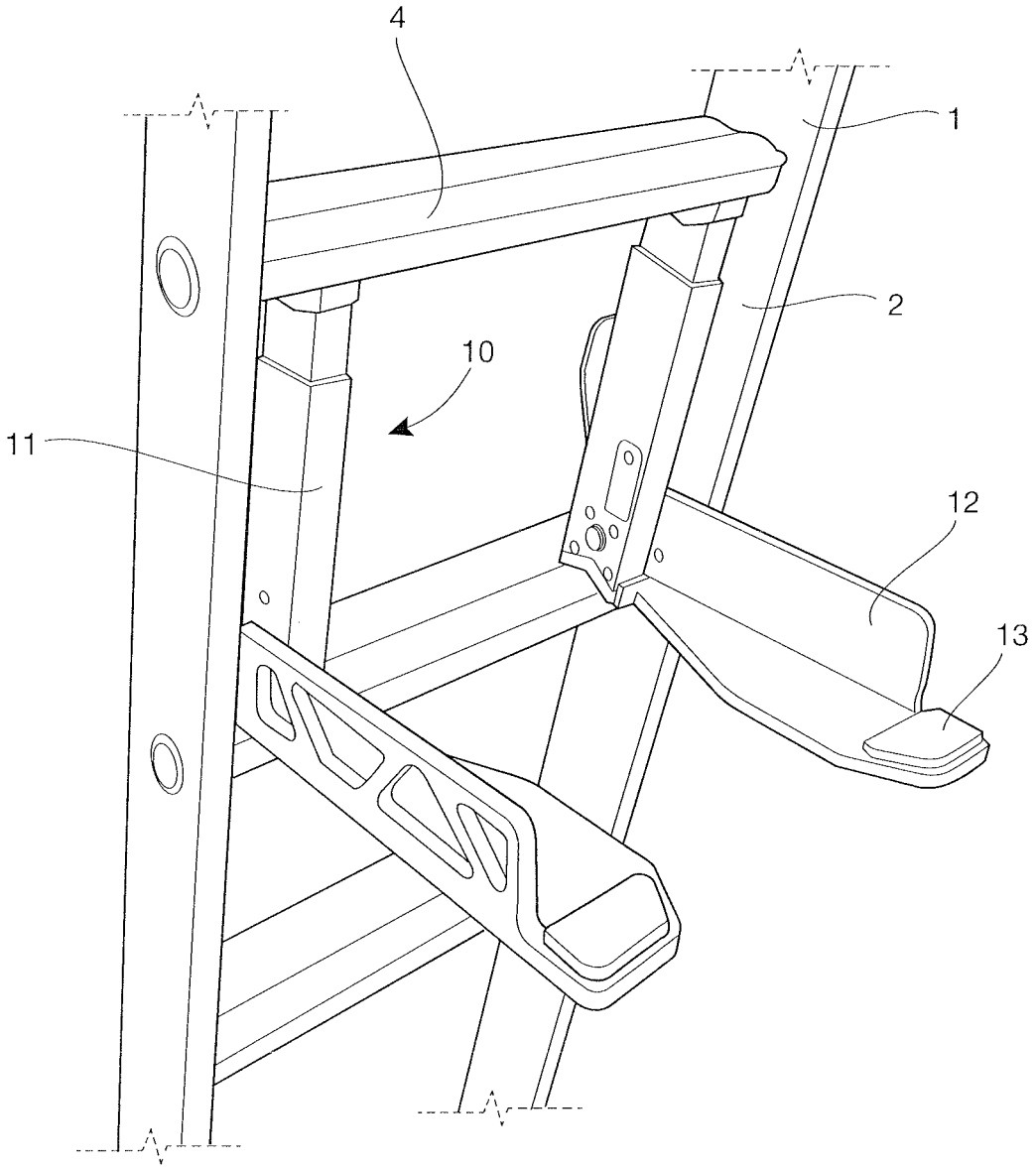
FIG. 5 is a perspective view of a stabiliser device secured to a ladder and arranged in a deployed configuration.
Figure 6:
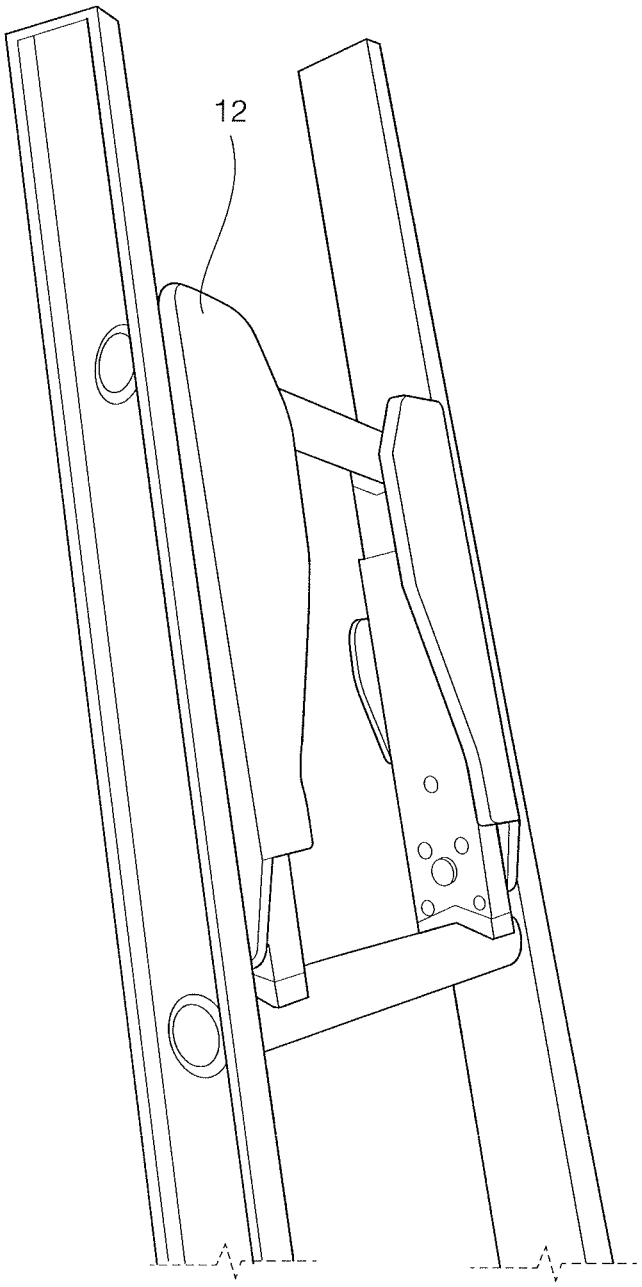
FIG. 6 is a perspective view of the stabiliser device shown in FIG. 1A arranged in a stowed configuration.

FIGS. 5 and 6 show a pair of stabiliser devices 10 secured to a ladder 1. The devices 10 are generally for stabilising the ladder 1 against a surface (not shown) extending from or affixed to a structure (not shown).

Figure 4:
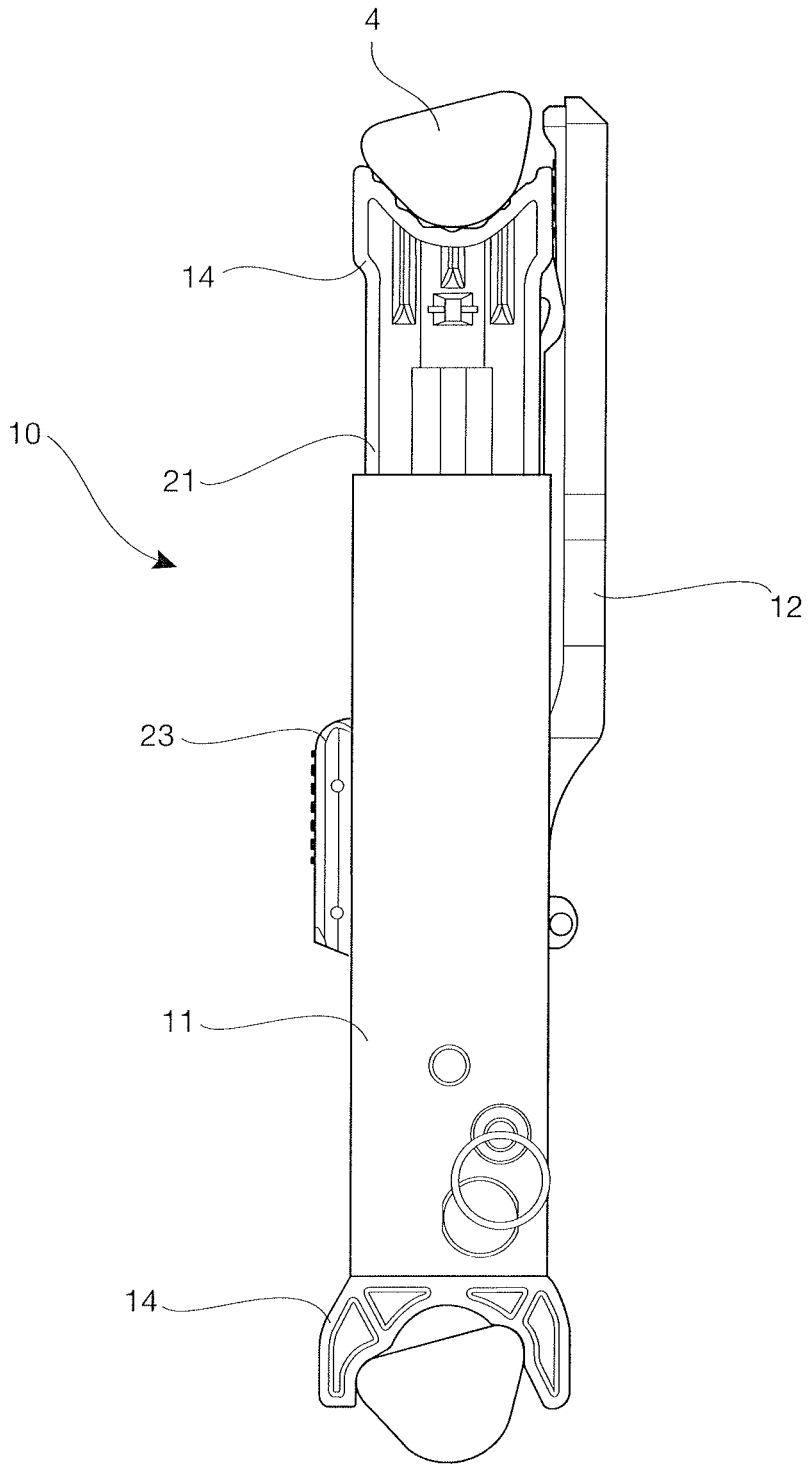
FIG. 4 is a side elevation view of the stabiliser device shown in the stowed position.

The ladder 1 has a pair of stiles 2 and a plurality of rungs 4 connected therebetween. Each stile 2 has an inner face 5 arranged opposite the other, between which each rung 4 is connected. Each stabiliser device 10 includes an engagement mechanism 11 for releasably engaging the ladder 1 and at least one arm 12 pivotably connected thereto. Typically, the device 10 includes a single arm 12 which is pivotable between a stowed configuration (as shown in FIGS. 4 and 6), in which the arm 12 is arranged substantially parallel to the stiles 2, and a deployed configuration (as shown in FIGS. 1 and 5), in which the arm 12 extends away from the stiles 2 at a predetermined angle. The arm 12 includes an abutting portion 13 for abutting under the surface.

The device 10 is often used as part of an assembly, comprising a pair of like devices 10, as shown in FIGS. 1 and 2 and 5 and 6, thereby providing a pair of arms 12 for stabilising the ladder 1. Alternatively, a single device 10 may be affixed to the ladder 1, having one or more arms 12. Where a single device 10 having a single arm 12 is employed (not shown), the arm 12 may be adapted to have a broad abutting portion 13 to increase the contact area of the arm 12 against the surface.

The engagement mechanism 11 is configured to releasably engage two adjacent rungs 4. The mechanism 11 includes two opposed receiving portions 14 each adapted to at least partially receive a rung 4, at least one of the receiving portions 14 being selectively movable relative to the other, thereby allowing the engagement mechanism 11 to urge the receiving portions 14 against the adjacent rungs 4 and engage the device 10 with the ladder 1.

The engagement mechanism 11 of each device 10 is typically engaged with the rungs 4 to position each device adjacent a respective stile 2. This ensures that regardless of configuration (deployed/stowed), the device 10 is arranged within the boundaries of the stiles 2 and forms a space between the devices 10, thereby optimising access to the rungs 4. This arrangement particularly useful if the ladder 1 is an extendable ladder (not shown), whereby each stile 2 must slide through a sleeve or guide (not shown), and therefore the device 10, when arranged in the stowed configuration, does not interfere with the sleeve/guide and does not prevent the ladder 1 from being extended or retracted.

Typically, the device 10 is used in an assembly comprising a pair of like devices 10 to allow the assembly to be readily adjusted in width to fit to different ladders and optimise access to the rungs 4. Alternatively, the engagement mechanism 11 may include a pair of engaging portions (not shown) each including a pair of opposed and selectively movable receiving portions for at least partially receiving the rungs 4. The pair of engaging portions are connected and selectively movable relative to each other to adjust the width of the device for different ladders. In this embodiment, each engaging portion may have an arm 12 pivotably connected thereto. In either case, arranging the device 10 (or engaging portions) adjacent the stiles 2 optimises space therebetween and minimises any obstruction to a user climbing the ladder 1 caused by the device 10.

The assembly comprising two like devices 10 may include two identical devices 10. Alternatively, the devices 10 may be adapted to be left or right sided, as shown in FIGS. 5 and 6, whereby a left side device 101 has the arm 12 arranged on a left side thereof, and a right side device 102 has the arm 12 arranged on a right side thereof, allowing the device 10 to be engaged with the ladder 1 such that the arms 12 are proximal to the inner faces 5 of the stiles 2.

As best shown in FIG. 6, when the device 10 is arranged in the stowed configuration, the arms 12 are pivoted towards the engagement mechanism 11 and arranged substantially parallel to the stiles 2, and inboard thereof. This arrangement generally ensures the device 10 fits within the width of the stiles 2 when in the stowed configuration. This is particularly useful if the ladder 1 is an extendable ladder (not shown) as this means the device does not interfere with any sleeve/guide or other telescoping mechanism, and therefore does not prevent the ladder 1 from being extended or retracted.

Figure 7:
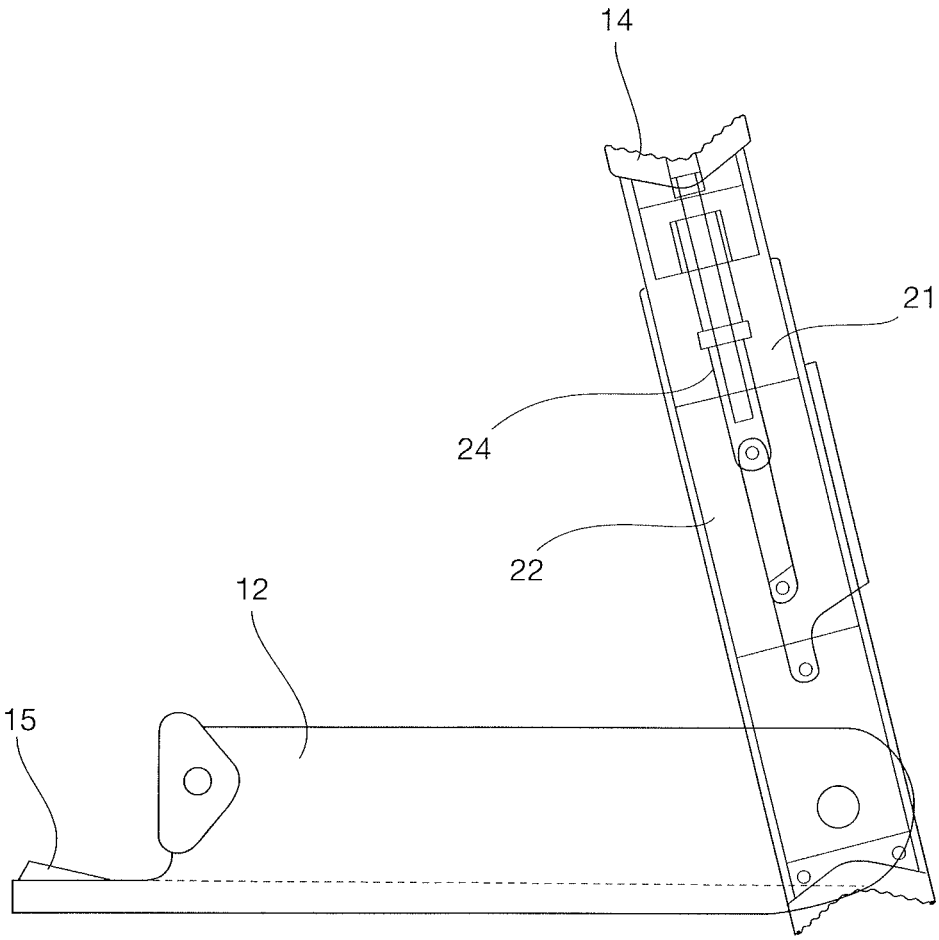
FIG. 7 is a side view of the stabiliser device shown in the previous figures in isolation.

FIG. 7 shows a side view of the device 10 shown in FIGS. 5 and 6 in cross-section through the engagement mechanism 11. The engagement mechanism 11 includes receiving portions 14 at either end thereof, each portion 14 adapted to at least partially receive a rung 4. At least one receiving portion 14 is selectively movable relative to the other receiving portion 14, thereby allowing the engagement mechanism 11 to engage between two adjacent rungs 4. This typically involves one receiving portion 14 being mounted on a movable portion 21 slidable relative to a housing 22.

In use, the movable portion 21 is actuated by operating a lever 23 connected to the movable portion, typically via one or more struts 24. Moving the lever upwards drives the upper receiving portion 14 up and into engagement with the upper rung so that the device 10 is in the retained position (FIG. 1 and the like), while moving the lever 23 downward releases the upper receiving portion 14 from the upper rung 4.

Once the lever 23 actuates the upper receiving portion 14 so that the device is in the retained position, the operator can deploy the arms 12. The arms 12 are deployed into the deployed position by extracting a pin from an inner face of the engagement mechanism 11. The pin then allows the arm 12 to drop into the deployed position and the pin may be reinserted to lock the arm 12 in that deployed position. There may be one or more deployed positions, depending on the number of corresponding holes into which the pin may be inserted.

It is to be understood that there may be another mechanism by which the arms are deployed. They may be wound outwards by a threaded mechanism supported by an intermediate brace, not unlike a window winder, or there may be a bracing arm with one position.

In one embodiment there may be a fixed arm extending from a rung or a stile with no stowed position. In this embodiment there may be a separate expansion mechanism extending between two rungs which may elevate one extensible ladder portion so that the abutting portion 13 may engage the surface for wedging the ladder into place against the surface.

Figure 11:
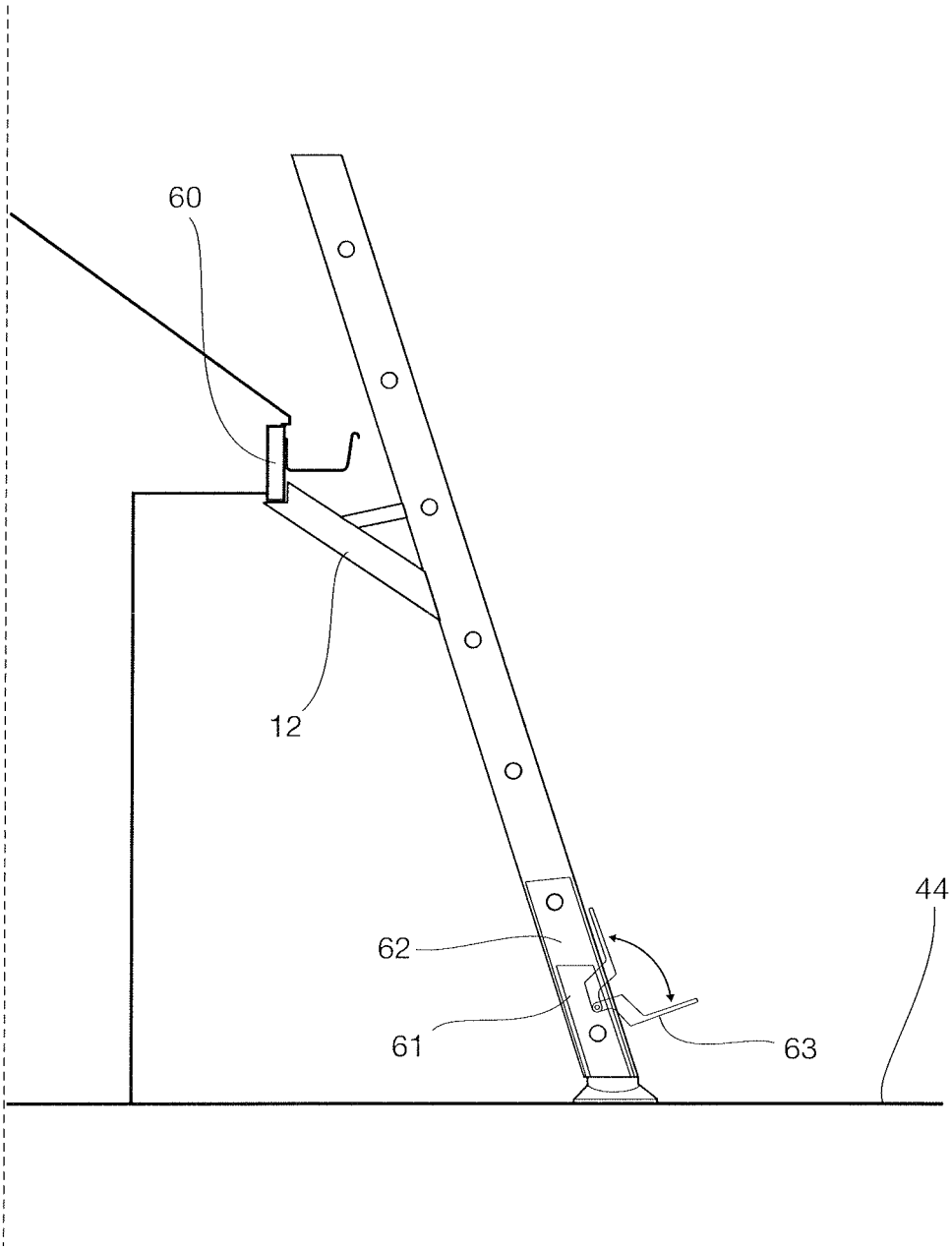
FIG. 11 shows a side view of a further alternative stabiliser device secured to a ladder and arranged against a structure.

There may be a jacking foot to raise the whole ladder which is disposed at the base of the ladder. The arm may be disposed adjacent the surface so as to engage that surface. This arrangement is shown at FIG. 11.

The arm 12 is shown in at least FIGS. 1, 2, 3, 5 and 7, pivoted away from the engagement mechanism 11, revealing an abutting portion 13 at an end thereof. The abutting portion 13 is arranged to abut underneath a surface (not shown), importantly providing a contact region between the device 10 and a structure the device 10 is stabilising a ladder 1 against. The abutting portion 13 is typically adapted to grip the surface, for example, by having synthetic rubber pads 15 secured thereto which increase friction between the abutting portion 13 and the surface. The abutting portion 13 may also be adapted to at least partially receive or engage a corner, typically comprising two surfaces 16 arranged at right angles to each other to receive respective surfaces of the structure, such as an eave or windowsill. This further enhances the engagement of the device 10 with the structure, thereby further stabilising the ladder 1. The abutting portion 13 may further comprise a pivotable flange 19 secured to one or both of these surfaces 16 to allow the portion 13 to conform to different corner geometries. The pivotable flange 19 can pivot about +/−10 degrees but could pivot any other suitable number of degrees to allow some flexibility of installation.

Figure 8:
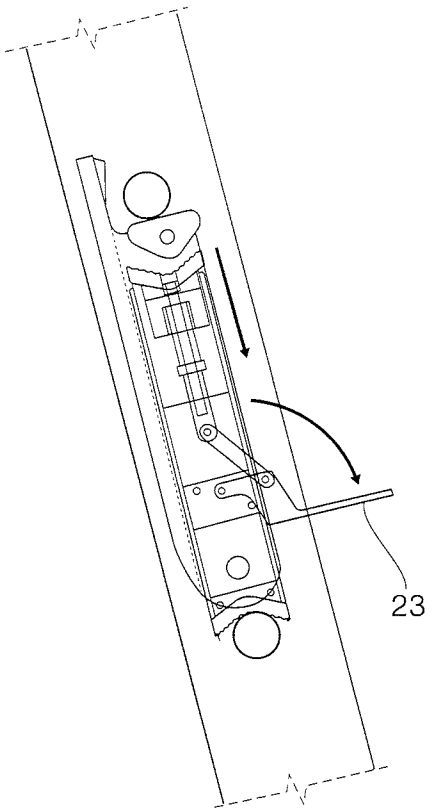
FIGS. 8(*i*)-8(*iii*) show three side views of the stabilizer device shown in the previous figures in deployed, stowed, and disassembly configurations.
Figure 8:
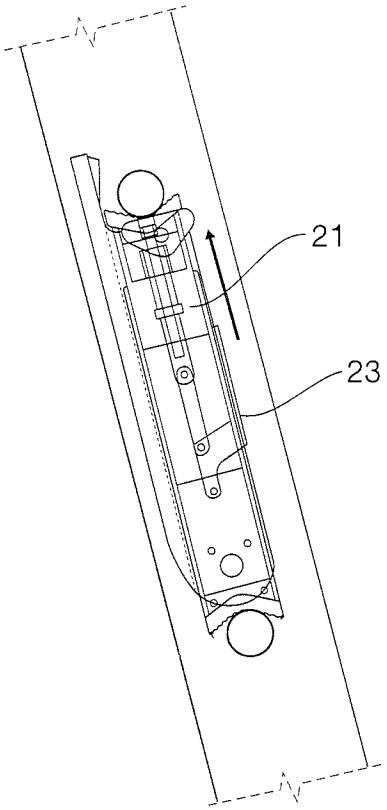
Figure 8:
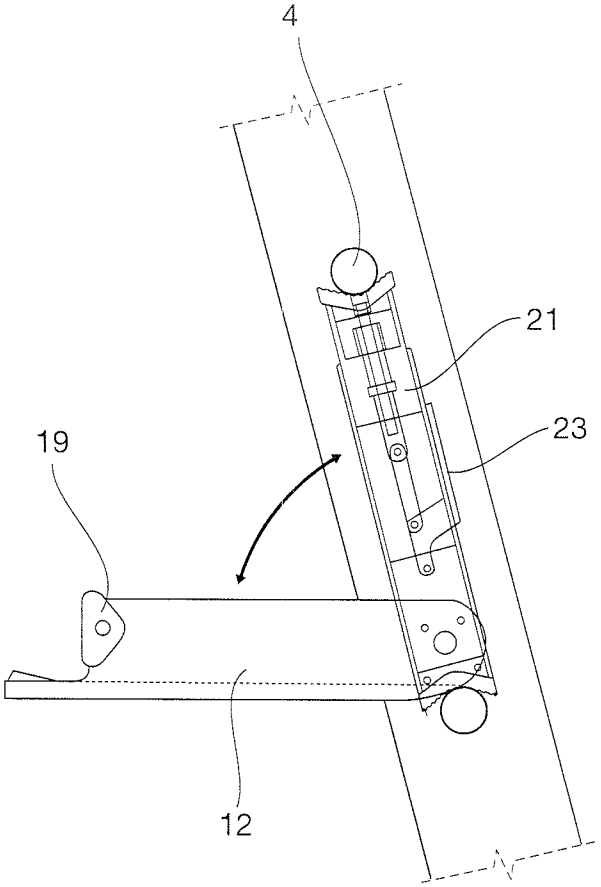

FIG. 8 (FIGS. 8(*i*), 8(*ii*) and 8(*iii*)) shows three further side elevation views of the device 10 arranged between two adjacent rungs 4, illustrating the engagement mechanism 11 being operated. As shown in the left and middle views, moving the lever 23 towards the housing 22 extends the movable portion 21 away from the housing 22 and against a rung 4, thereby engaging the device 10 with the ladder 1. As shown in the right view, moving the lever away from the housing 22 retracts the movable portion 21 within the housing 22 and away from the rung 4, thereby disengaging the device 10 with the ladder 1.

Figure 9:
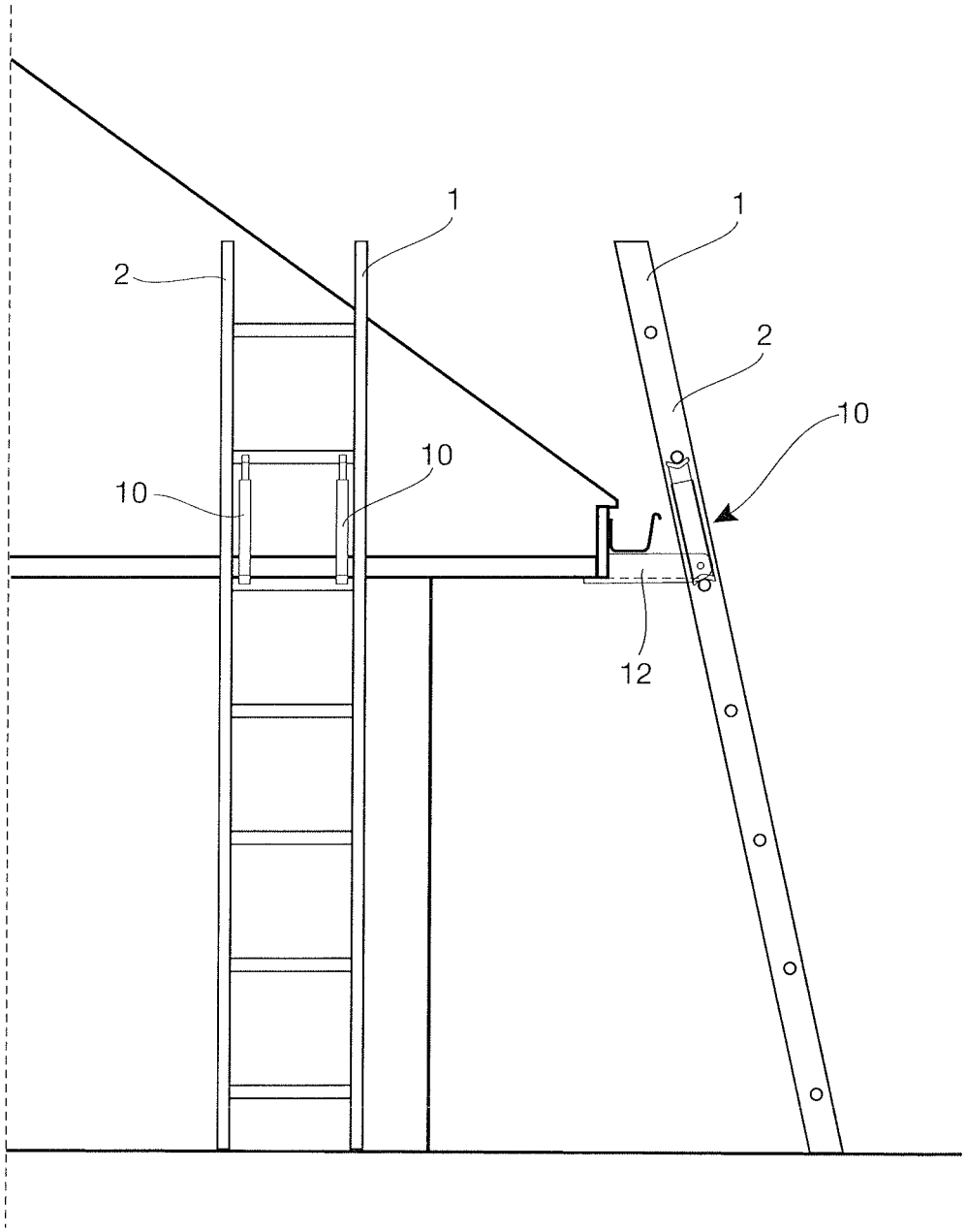
FIG. 9 shows a side a front view of the stabiliser device and ladder shown in FIGS. 5 and 6 arranged against a structure.

FIG. 9 shows a side and front view of the device 10 engaged with the ladder 1 and stabilising the ladder 1 against a surface 40 extending from a structure 41. The arm 12 is arranged in the deployed configuration, extending away from the stiles 2. The abutting portion 13 is arranged under the surface 40. The surface 40 is connected to an end face 42 and the abutting portion 13 is also abutted against the end face 42. When the abutting portion 13 is arranged against the surface 40, and potentially also the end face 42, a bottom end 17 of each stile 2 is moved towards the structure 41, thereby wedging the ladder between the surface 40 and a ground level 44. The arrangement of the device 10 and ladder 1 in this way securely engages the ladder 1 with the structure 41 and surface 40, minimising side-to-side movement of the ladder 1 and significantly reducing the likelihood of the ladder 1 falling backwards, away from the structure 41.

Figure 10:
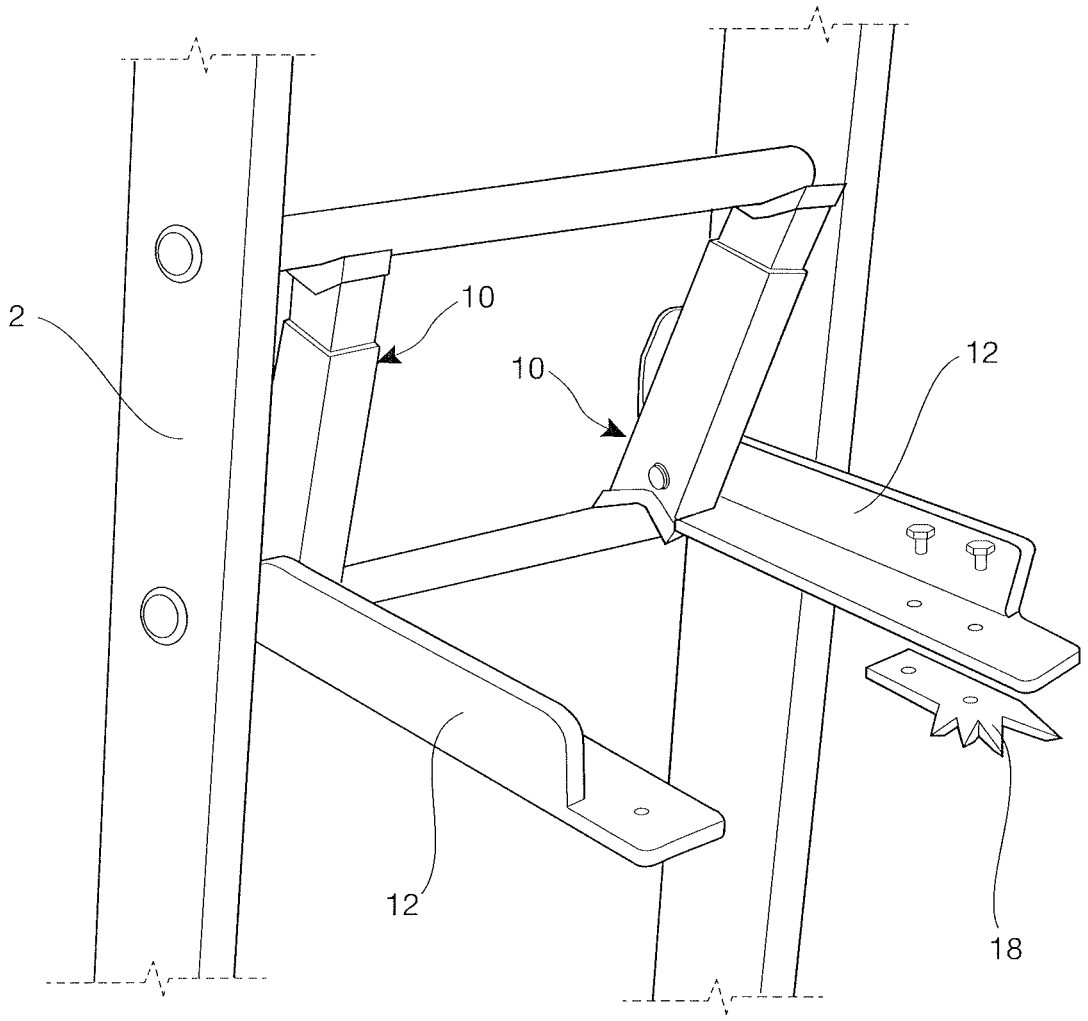
FIG. 10 shows a perspective view of an alternative stabiliser device secured to a ladder.

FIG. 10 shows a variation of the device 10 where the arm 12 is adapted to be releasably connected to a tree spike 18. The tree spike has one or more sharp protrusions extending therefrom for penetrating a tree (not shown), thereby allowing the device to stabilise the ladder 1 against a tree.

FIG. 11 shows a side view of the device 10 engaged with the ladder 1 and stabilising the ladder against an alternative structure 60. The device 10 forms part of an alternative assembly, further comprising a jack foot 61 connected to the bottom end 17 of at least one stile 2. The jack 61 has an extendable portion 62 operable by a lever 63. Operation of the lever 63 extends the extendable portion 62 causing the ladder 1 to move away from the ground level 44. This consequently urges the device 10 against the structure 60, further reducing the likelihood of side-to-side or rearward movement of the ladder 1.

Figure 12:
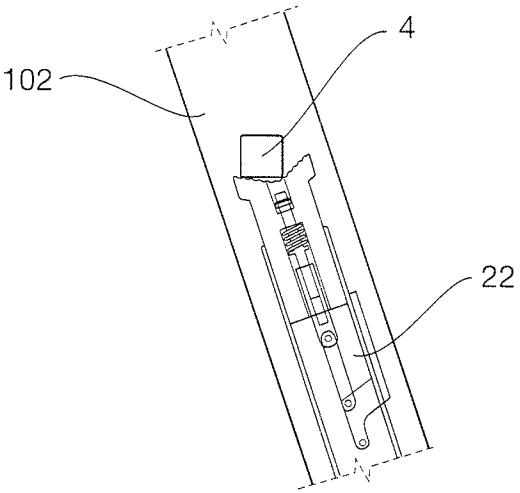
FIGS. 12 (*i*)-12(*iii*) show three side views of the stabilizer device shown in FIGS. 5 to 9 secured to three different ladders and a rung adaptor.
Figure 12I:
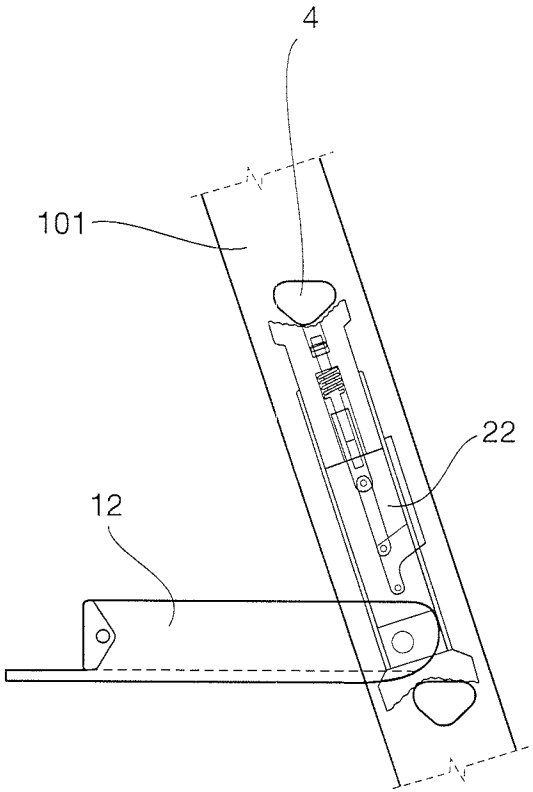

FIG. 12 shows FIGS. 12(*i*)-12(*iii*) show three side views of the device 10 engaged w three different ladders 101, 102, 103, each having a differently shaped rung profile. The left and middle view illustrate the receiving portion 14 receiving the respective rungs to a different depth. The right view illustrates the receiving portion 14 receiving a rung adaptor 20 shaped to engage the rung profile of the respective ladder 103.

Figure 13I:
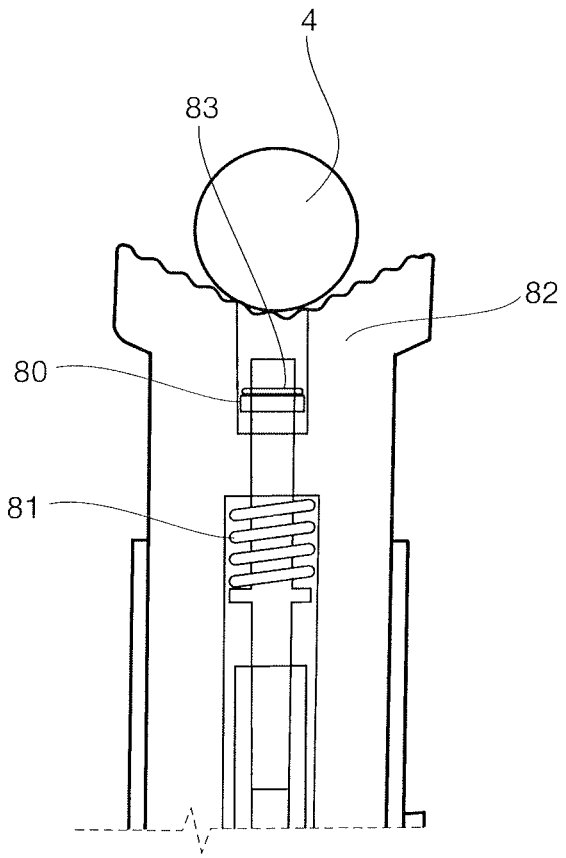
FIGS. 13(*i*) and 13(*ii*) show two detailed views of an engagement mechanism of the stabilser device shown in the previous figure.
Figure 13:
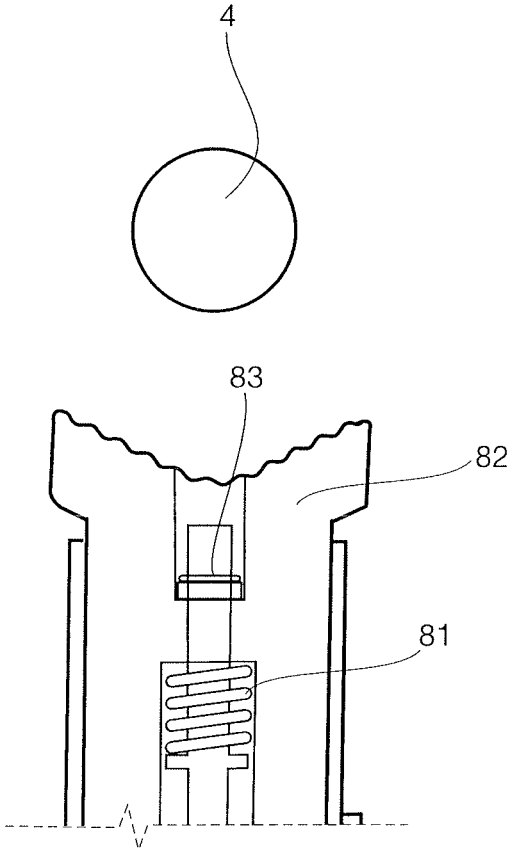

FIGS. 13(*i*) and 13(*ii*) show two detailed views of the engagement mechanism 11, the left view showing the engagement mechanism 11 in an installed configuration where the receiving portion 14 is urged against the rung 4, and the right view showing the engagement mechanism 11 in a released configuration where the receiving portion 14 is moved away from the rung 4. The engagement mechanism 11 may further comprise an adjustment mechanism for adjusting the length of the engagement mechanism 11 to allow the engagement mechanism 11 to engage a range of spans between adjacent rungs 4. The adjustment mechanism typically comprises an adjuster 80 selectively movable relative to the strut 24, typically by being threadably engaged. The adjuster 80 is arranged against a resilient element 81, such as a coil spring, which is trapped between the adjuster 80 and the movable portion 21. Moving the adjuster 80 relative to the strut 24, for example, by screwing the adjuster 80 towards or away from the strut 24, allows the engagement mechanism 11 to be adjusted in length, thereby allowing the mechanism 11 to be adapted for different ladders 1 having different span dimensions between rungs 4. Operating the lever 23 urges the strut 24 and adjuster 80 towards the receiving portion 14, which compresses the resilient element 81 and causes the movable portion 21 and associated receiving portion 14 to extend away from the housing 22.

The engagement mechanism 11 typically further comprise an installation indicator for indicating when the mechanism 11 has securely engaged between the two rungs 4. This typically comprises a first marking 82 on the movable portion 21 and a second marking 83 on the adjuster 80 which align when sufficient clamping force has been applied by the mechanism 11. In the event the markings 82, 83 do not align when the engagement mechanism 11 is installed between two rungs 4, the adjuster 80 can be moved away from the strut 24, typically by screwing, to further compress the resilient element 81 and increase the clamping force, until the markings align 82, 83.

Figure 14:
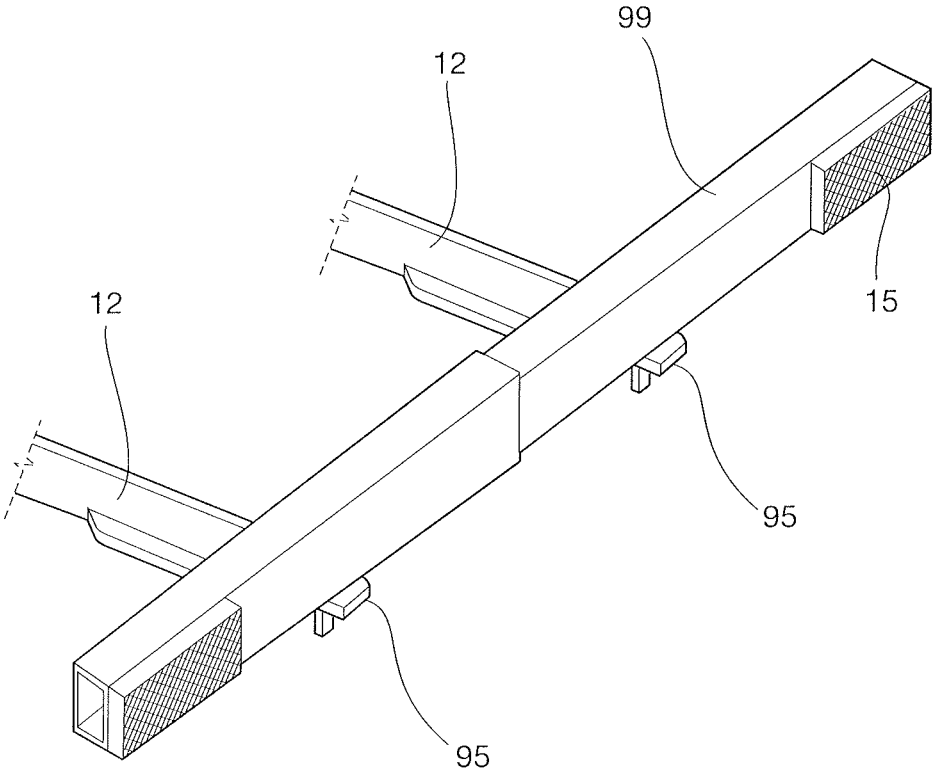
FIG. 14 is an isometric view of the stabiliser device shown in the deployed position with an extensible cross member disposed between the arms.

FIG. 14 shows a perspective view of a telescopic cross member 99 attached to the abutting portion by fasteners which in this embodiment are pins 95. The cross member includes a hollow section with pads 15 for engagement with a surface.

Although the invention is described above with reference to specific embodiments, it will be appreciated that it is not limited to those embodiments and may be embodied in other forms.

Throughout this specification and the claims that follow, the word "comprising" and all its forms such as comprise and comprises, is intended to be an inclusive term and is not to be taken as to exclude other features.

The invention claimed is:

1. A device for stabilizing a ladder against a surface, the ladder having a pair of stiles and a plurality of rungs connected therebetween, the device comprising:

an engagement mechanism for releasably engaging two adjacent rungs, the engagement mechanism including two opposed receiving portions, each receiving portion is configured to at least partially receiving a rung of the two adjacent rungs, at least one of the receiving portions being selectively linearly extensible relative to the other of the two opposed receiving portions thereby allowing the engagement mechanism to abut against adjacent surfaces of the adjacent two rungs; and at least one arm pivotably connected to the engagement mechanism to allow pivoting thereof to a fixed angle relative to the engagement mechanism, the at least one arm having an abutting portion for abutting under the surface, thereby allowing the ladder to be wedged between the surface and ground level to stabilise the ladder, wherein the engagement mechanism further comprises:

an adjustment mechanism for selecting a distance between the receiving portions in an engaged position in which the receiving portions abut the two adjacent rungs, the adjustment mechanism includes a resiliently mounted strut, wherein the adjustment mechanism further includes a resilient element and an adjuster to selectively move the strut relative to a housing of the engagement mechanism so as to adjust a tension in the resilient element, and an actuation lever pivotally connected to the engagement mechanism, the actuation lever being pivotally connected to the strut, and wherein the actuation lever is configured to extend at least one of the receiving portions into the engaged position in which the receiving portions are disposed substantially the distance apart that is set by the adjustment mechanism.

2. The device according to claim 1, wherein the abutting portion includes a recess arranged to receive a corner.

3. The device according to claim 2, wherein the abutting portion further includes a pivotable flange disposed in the recess to allow the abutting portion to conform to different corner geometries.

4. The device according to claim 3, wherein the pivotable flange is configured to pivot about +/−10 degrees.

5. The device according to claim 1, further including a first marking disposed on the extensible element and a second marking on the adjuster.

* * * * *